United States Patent [19]

Kleckner

[11] Patent Number: 4,805,367

[45] Date of Patent: Feb. 21, 1989

[54] VENTILATING SUPPORT FOR ROOF INSULATION

[76] Inventor: John R. Kleckner, 3205 Fulton St., Laureldale, Pa. 19605

[21] Appl. No.: 67,293

[22] Filed: Jun. 26, 1987

[51] Int. Cl.[4] ..... E04B 5/00

[52] U.S. Cl. ..... 52/408; 52/199; 52/648; 428/255; 428/256

[58] Field of Search ..... 52/648, 650, 169.5, 52/408, 199; 428/105, 108, 175, 183, 185, 255, 256

[56] References Cited

U.S. PATENT DOCUMENTS

| | | | |
|---|---|---|---|
| 3,258,891 | 7/1966 | Haberbosch | 52/650 |
| 3,298,152 | 1/1967 | Lockshaw | 52/650 |
| 3,347,007 | 10/1967 | Hale | 52/648 |
| 3,654,765 | 4/1972 | Healy | 52/169.5 |
| 3,884,646 | 5/1975 | Kenney | 52/648 |
| 4,001,475 | 1/1977 | Chambers | 428/175 |
| 4,239,795 | 12/1980 | Haage | 52/408 |
| 4,315,392 | 2/1982 | Sylvest | 52/408 |
| 4,534,142 | 8/1985 | Drefahl | 52/408 |
| 4,538,388 | 9/1985 | Friesen | 52/408 |

*Primary Examiner*—Henry E. Raduazo

[57] ABSTRACT

A ventillating support upon which a roof insulation board can be rested to hold the board in spaced relationship with the roof deck and allow for an omnidirectional circulation of air to remove moisture that accumulates between the insulation and the deck. The device of this invention is a three-dimensional open-meshed rigid support made from intersecting sets of undulating elongated elements that are joined at their points of intersection. Preferably the elements are flattened at those points where they will contact the insulation or the roof deck.

7 Claims, 1 Drawing Sheet

VENTILATING SUPPORT FOR ROOF INSULATION

BACKGROUND OF THE INVENTION

1. Field of the Invention.

The field of the invention relates to a ventilating support for roof insulation and more particularly to a ventilating support which permits air to circulate at the interface between the roof insulation and a roof deck to inhibit the accumulation of moisture.

2. Description of the Prior Art.

The prior art recognizes that roof insulation of solid construction such as boards, will collect moisture at the interface between the roof deck and the facing surface of the board. Accumulated moisture can cause deterioration to and loss of the deck material through rot, if made of wood, or corrosion, if made of metal.

Corrugated metal roof decks, as shown, for example, in U.S. Pat. Nos. 4,073,997, and 3,029,172, illustrate flutes provided as part of the deck corrugation through which air may pass to prevent moisture from collecting. This configuration in combination with roof vents is helpful in the removal of moisture. However, as may be seen, air flow is only unidirectional along the central longitudinal axis of the flute. On a flat roof deck with a solid board not even a unidirectional passageway is available.

It is also known to provide a rough texture or bidirectional grooves on the roof deck facing surface of insulation board to permit omnidirectional air flow whether or not the board is applied to a corrugated roof deck or to a flat one. In this regard see, for example, U.S. Pat. No. 3,455,076, July 15, 1969, and Canadian No. 712,301. Canadian No. 712,301 teaches, in FIG. 3, for example, a cross-directional configuration consisting of a multiplicity of "V" shaped flutes which intersect at right angles to each other leaving a series of elongated truncopyramidal shaped bosses closely arranged with each other such that the base of each boss coincides with and is defined by the edge of the base of each adjacent boss. Such arrangements allow the unrestricted passage of air along the flutes so long as care is taken to align adjacent boards, flute to flute, during installation or, as is common in ordinary installations, so long as cut-to-size and fitted boards are not used. When care is not taken, flutes can be blocked by misalignment resulting in unvented or dead air pockets where moisture can accumulate. Therefore, the installer of this type of insulation must be sure that the boards are aligned properly in order to avoid pockets of dead air.

U.S. Pat. No. 3,387,420 discloses an insulating sheet which permits ventilation and avoids the possible dead air pockets of the Canadian Pat. No. 712,301. This is accomplished by spacing the insulating boards from each other so that none of the ventilating passageways between adjacent boards can be blocked. Unfortunately, the space left between boards has no insulation even though the spaces may be sealed by selvage strips (19*b* in FIG. 5) which overlaps adjaced boards.

SUMMARY OF THE INVENTION

Accordingly, it is an object of this invention to provide ventillation between roof insulation and a roof deck. Another object of this invention is to provide ventilation between roof insulation and a roof deck which will permit the omni directional flow of air and avoid the accumulation of moisture.

Yet another object of this invention is to provide a support upon which roof insulation can rest that will permit air to circulate between the roof insulation and the roof deck without regard to the orientation of adjacent supports or the insulation boards or the manner in which they are laid in place.

Briefly, these and other objects of this invention are achieved by providing a three-dimensional open-meshed rigid support that may be laid between a roof deck and its insulation. The three-dimensional aspect of the support acts to space apart the roof deck and the insulation. Since the support of this invention is an open-meshed structure, air can freely circulate in all directions in the space between the roof deck and the insulation.

DESCRIPTION OF THE DRAWINGS

Figure 1:
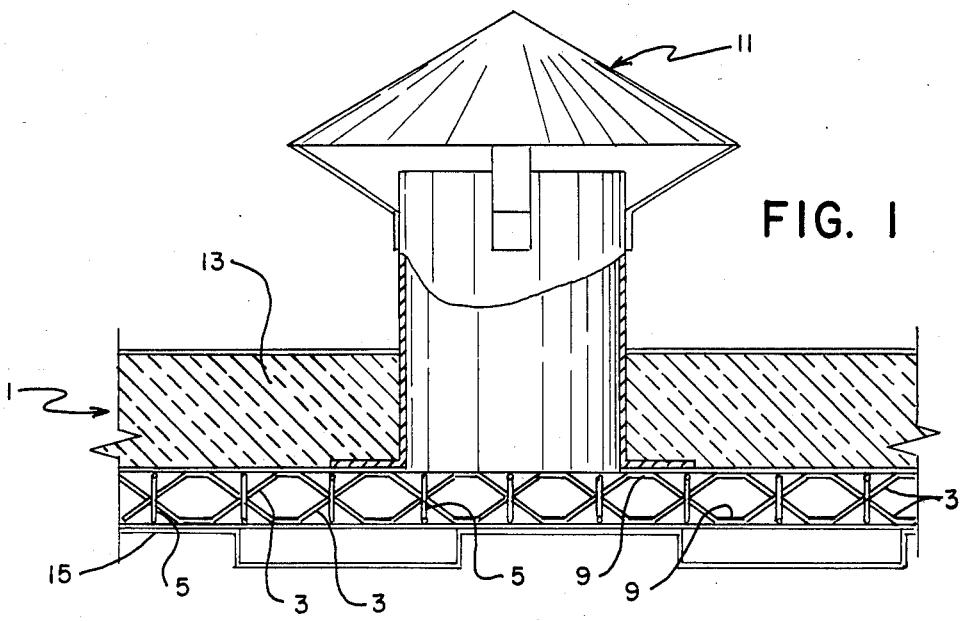
FIG. 1 is a schematic illustration of the ventilating support of this invention in its environment of use.

In FIG. 1 there is illustrated the use of the ventilating support 1 of this invention. The ventilating support 1 is seen resting upon the roof deck 15. Insulating material, here illustrated as an insulation board 13, rests upon the ventilating support 1 in spaced relationship to the roof deck 15. The ventilating support 1 is comprised of a screen or grid-like structures in which a series of regularly spaced apart, undulating, elongated elements 3 intersect at right angles with regularly spaced apart, undulating elongated elements 5. In order to make a rigid structure, the elongated elements 3 are joined as by welding with the elongated elements 5 at points 7 where the elements touch. While not a feature of this invention, FIG. 1 illustrates a ventilator 11 which can be used to advantage since it provides a means for any moisture accumulation the space between the insulation 13 and the roof deck 15 to exhaust to the atmosphere.

Figure 2:
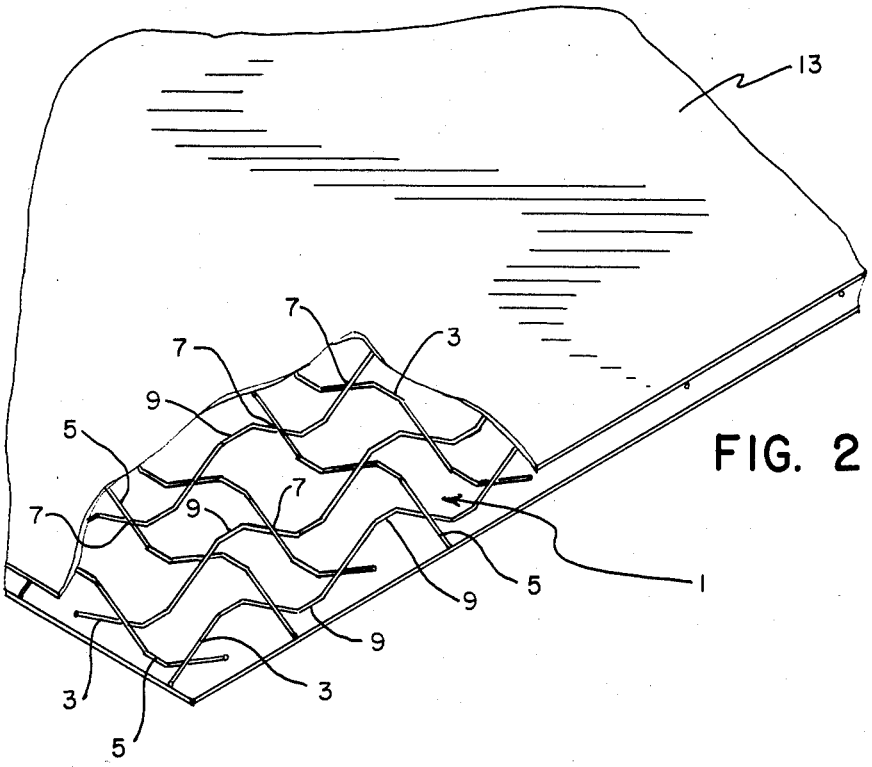
FIG. 2 is a perspective view of a preferred embodiment of this invention.

As best can be seen in FIG. 2, the elongated members, 3 and 5, are regularly bent or undulating in order to provide a three-dimensional structure in which the distance the insulation 13 is spaced from the roof deck 15 is defined by the amplitude of the unndulations in the elongated elements 3 and 5.

As best can be seen in FIG. 2, members 3 and 5 are aligned with respect to each other so that their points of intersection 7 are intermediate the high and low points of the undulations 9 where the members 3 and 5 are adapted to contact the insulation and the roof deck. This type of spacing provides greater stability by maximizing the points of contact between the support and the insulation and the roof deck.

In order to provide greater support and rigidity, the undulating elongated members 3 and 5 are flattened at those points 9 where they contact the insulation and the roof deck.

The elongated elements 3 and 5 of this invention can be made from most any material provided it has sufficient rigidity and strength to support the roof insulation. For example, the elongated elements can conveniently be made from metal wires or strands of high-strength plastics such as fibre reinforced nylon or polyacetal. The elongated elements 3 and 5 can be joined at their points of intersection such as, in the case of metals, by braising, soldering or tack welding, and, in the case of plastics, the strands can be joined at their intersections as by known fusion or solvent bonding techniques.

The ventilating support 1 of this invention can be made either in the form of sheet-like sections or, particularly with the case of a plastic construction, can be made in continuous lengths and stored in rolls. In either case, however, it is a simple matter to lay the ventilating support on top of the roof support by cutting sheet or roll material as may be required. The important feature of this invention lies in the fact that no specific orientation is required and, no matter how haphazardly or irregularly the ventilating support of this invention is laid on the roof support, omnidirectional flow of air between the roof support and the roof insulation will be insured.

As previously discussed, some prior art devices utilize insulating board that contain flutes in the insulation board to provide a path for ventilation. It should be understood that when a flute is cut in one surface of the insulation board, the insulating value of that insulation board is reduced in direct proportion to the amount of material removed to form the flutes. However, in the practice of the instant invention, no sacrifice is made in the insulating value of the insulating board and it is, therefore, fully utilized. It is similarly true that spaces do not have to be left between adjacent insulating boards to insure moisture removal at the end of flutes which might otherwise abut against adjacent insulating boards. Thus, in the practice of this invention, the insulating value of the insulating boards is fully utilized.

In summary, in the practice of this invention, an omnidirection circulation of air is insured without exercising any particular care in the way in which the ventilating support or the insulation is laid on the roof deck. Further, it is not necessary to provide spacing between adjacent insulating boards, it is not necessary to align flutes of adjacent insulating boards with each other, nor is it necessary to reduce portions of the cross-sectional area an insulating value of the insulating board to provide for adequate ventillation and moisture removal.

I claim:

1. A ventilating support adapted to support roof insulation in spaced relationship from a roof deck, the ventilating support being comprised of two sets of similarly shaped undulating elongated members, the first set of elongated members extending in an angular direction with respect to the second set of elongated members and intersecting the second set of members, the members rigidly affixed to each other at the points of intersection, and the points of intersection of the members being intermediate the high and low points of the undulating members.

2. A ventilating support accordingly to claim 1 in which the one set of members is oriented in a plane that is at right angles to the plane of orientation of the other set of members.

3. A ventilating support according to claim 1 in which the undulating members are flattened at those points where they contact the insulation and the roof deck.

4. A ventillating support accordingly to claim 1 wherein the elongated elements are metal wires.

5. A ventilating support according to claim 1 in which the elongated members are extruded strands of high strength plastics.

6. A ventilating support according to claim 5 in which the high strength plastic is a nylon or a polyacetal.

7. A ventilating support according to claim 6 wherein the plastic is reinforced.

* * * * *